US011141832B2

(12) United States Patent
Watanabe

(10) Patent No.: US 11,141,832 B2
(45) Date of Patent: Oct. 12, 2021

(54) WATER DISCHARGE SYSTEM, WATER DISCHARGE METHOD, WATER DISCHARGE CONTROL APPARATUS, WATER DISCHARGE CONTROL METHOD, SUBSTRATE PROCESSING APPARATUS AND NON-TRANSITORY COMPUTER READABLE MEDIUM RECORDING WATER DISCHARGE CONTROL

(71) Applicant: EBARA CORPORATION, Tokyo (JP)

(72) Inventor: Hiromitsu Watanabe, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 333 days.

(21) Appl. No.: 15/427,245

(22) Filed: Feb. 8, 2017

(65) Prior Publication Data

US 2017/0229323 A1 Aug. 10, 2017

(30) Foreign Application Priority Data

Feb. 10, 2016 (JP) ..... JP2016-023844

(51) Int. Cl.

| | |
|---|---|
| ***B08B 1/00*** | (2006.01) |
| ***H01L 21/67*** | (2006.01) |
| ***B24B 57/02*** | (2006.01) |
| ***B08B 1/04*** | (2006.01) |
| ***B08B 3/08*** | (2006.01) |

(Continued)

(52) U.S. Cl.

CPC ..... *B24B 57/02* (2013.01); *B24B 37/10* (2013.01)

(58) Field of Classification Search

None

See application file for complete search history.

(56) References Cited

U.S. PATENT DOCUMENTS 5,791,970 A * 8/1998 Yueh ..... B24B 37/04 451/446
6,106,728 A * 8/2000 Iida ..... B24B 57/02 210/167.3

(Continued)

FOREIGN PATENT DOCUMENTS

JP H11-347940 A 12/1999
JP 2000-286224 A 10/2000

(Continued)

OTHER PUBLICATIONS

Machine Generated English Translation of the abstract of WO2015133516 held to Yamaguchi et al. Published Sep. 11, 2015 (Year: 2015).*

(Continued)

*Primary Examiner* — Sylvia MacArthur

(74) *Attorney, Agent, or Firm* — Pearne & Gordon LLP

(57) ABSTRACT

A water discharge system for a substrate processing apparatus comprising a substrate processor that processes a substrate using liquid, includes: at least two water discharge lines capable of discharging the liquid used in the substrate processor; a switching device configured to switch a water discharge line to which the liquid used in the substrate processor is to be discharged among the at least two water discharge lines; a measurement device configured to generate water discharge information by measuring the liquid used in the substrate processor; and a control mechanism configured to control the switching device in accordance with the water discharge information.

18 Claims, 14 Drawing Sheets

(51) Int. Cl.
*B08B 3/14* (2006.01)
*B24B 37/10* (2012.01)

(56) References Cited

U.S. PATENT DOCUMENTS 6,126,531 A * 10/2000 Iida ..... B24B 37/04 451/447
6,508,695 B2 * 1/2003 Tanikawa ..... B24B 37/04 210/194
6,547,961 B2 * 4/2003 Uto ..... B24B 37/04 210/167.31
7,479,205 B2 * 1/2009 Okuda ..... B08B 1/04 134/113
8,696,404 B2 * 4/2014 Sun ..... B24B 57/02 210/195.1
2001/0034190 A1 10/2001 Tanikawa et al.
2003/0189004 A1 * 10/2003 Chang ..... B24B 37/04 210/650
2004/0084143 A1 * 5/2004 Ivanov ..... B24B 49/14 156/345.11
2006/0266736 A1 * 11/2006 Tregub ..... C09G 1/02 216/84
2009/0298393 A1 * 12/2009 Kozasa ..... B24B 1/04 451/41
2010/0270403 A1 * 10/2010 Gotou ..... B24B 37/04 241/5
2012/0042575 A1 2/2012 Amoroso et al.
2013/0291444 A1 11/2013 Matsuo et al.
2014/0069890 A1 * 3/2014 Yavelberg ..... B24B 37/34 216/53
2017/0066101 A1 * 3/2017 Yamaguchi ..... B24B 37/00
2017/0229323 A1 * 8/2017 Watanabe ..... B24B 37/10

FOREIGN PATENT DOCUMENTS

JP 2001-269868 A 10/2001
JP 2002-134458 A 5/2002
JP 2013-535848 A 9/2013
JP 2013-219307 A 10/2013
WO WO-2015133516 A1 * 9/2015 ..... H01L 21/67017

OTHER PUBLICATIONS

Machine Generated English Translation of thee laims ofWO2015133516 held to Yamaguchi et al. Published Sep. 11, 2015 (Year: 2015).*
Machine Generated English Translation of the description of WO2015133516 held to Yamaguchi et al. Published Sep. 11, 2015 (Year: 2015).*
Japanese Office action issued in Japanese Patent Application No. 2016-023844 dated Jul. 9, 2019.
Japanese Office action issued in Japanese Patent Application No. 2016-023844 dated Apr. 23, 2019.

* cited by examiner

WATER DISCHARGE SYSTEM, WATER DISCHARGE METHOD, WATER DISCHARGE CONTROL APPARATUS, WATER DISCHARGE CONTROL METHOD, SUBSTRATE PROCESSING APPARATUS AND NON-TRANSITORY COMPUTER READABLE MEDIUM RECORDING WATER DISCHARGE CONTROL

CROSS-REFERENCE TO RELATED APPLICATIONS

This application claims the benefit of Japanese Priority Patent Application JP 2016-23844 filed on Feb. 10, 2016, the entire contents of which are incorporated herein by reference.

FIELD

The present technology relates to a system (method) for discharging used slurry, used chemical liquid, used pure water, and other liquids in a substrate processing apparatus, an apparatus that controls a water discharge apparatus for the substrate processing apparatus, a control method, a control program, and a recording medium storing the control program.

BACKGROUND AND SUMMARY

A substrate processing apparatus is often used in general semiconductor manufacturing processes, such as planarization of the surfaces of wafers to be used in manufacturing semiconductor devices such as CPUs, and wire manufacturing process for circuit formation. In semiconductor manufacturing, it is particularly important to achieve planarized surfaces. One of the techniques for the planarization is a chemical mechanical polishing (CMP) apparatus. This CMP apparatus is capable of increasing the mechanical polishing (surface removal) effect of relative movement between a polishing agent and the object to be polished, by virtue of a surface chemical action of the polishing agent (abrasive grains) or an action of chemical components contained in the polishing liquid. Thus, the CMP apparatus can quickly form a smooth polishing surface.

The configuration of a substrate processing apparatus is now briefly described with reference to FIG. 1. A substrate processing apparatus 1 generally includes a polisher 3 that polishes a substrate such as a semiconductor wafer, a cleaner 5 that cleans the polished substrate, and a housing 4 that houses the polisher 3 and the cleaner 5. The slurry, the pure water, the waste liquid, and the like used in the substrate processing apparatus 1 are normally collected and processed by a water discharger 7 installed outside the substrate processing apparatus 1, or more specifically, outside the housing 4, and are then discarded or recycled.

The polishing slurry to be used in the substrate processing apparatus 1 is expensive slurry containing rare metal, such as silica, alumina, ceria, zirconia, or titania. Chemical liquids for cleaning are also expensive, and such chemical liquids should be discarded with consideration for natural environments. Therefore, it is preferable in economic terms to separate or collect used waste liquids, and recycle or discard such used waste liquids in a simple manner. In the substrate processing apparatus 1, or more specifically, in a CMP apparatus, a large amount of pure water is used not only in the polisher 3 and the cleaner 5 housed in the housing 4, but also in an apparatus operation standby state and cleaning the respective components. Therefore, the used pure water is preferably collected, and is then discarded or recycled.

Polishing slurry recycling methods and pure water recycling methods that utilize a centrifugal separation method, sedimentation removal, and filter/membrane separation have been suggested to remove impurities such as grinding sludge contained in discharged water after waste liquids are collected outside the substrate processing apparatus 1.

For example, JP 2013-219307 A (Patent Literature 1) discloses a regeneration apparatus that regenerates trace metal ions by separating used slurry through gravitational sedimentation, concentrating the solid content, and then performing solid-liquid separation. Also, JP 11-347940 A (Patent Literature 2) discloses a polishing slurry generation (circulation) apparatus that filtrates used polishing slurry through a filter, processes the filtrated polishing slurry at a regenerator, and then returns the polishing slurry to a CMP apparatus.

As in these conventional technologies, used slurry, used chemical liquids, used pure water, and other liquids are normally collected and recycled at the water discharger 7 installed "outside" the substrate processing apparatus 1. It is surely convenient in terms of the handling of waste liquids, if waste liquids can be collected (reprocessed) exclusively at the water discharger 7 installed "outside" the substrate processing apparatus 1.

However, where the water discharger 7 is installed "outside" the substrate processing apparatus 1, the water discharge lines become longer, and slurry, grinding sludge, and cleaning materials remain in or adhere to the lines, resulting in adverse influence on processing and recycling efficiencies in some cases. Also, in a case where waste liquids are collected exclusively at the water discharger 7, recyclable slurry, pure water, cleaning materials, grinding sludge, and the like coexist in one place. As a result, complicated processing becomes necessary in discarding, reprocessing, and recycling processes. Further, in conventional processing of used slurry, grinding sludge and the like are removed, and slurry and pure water are separated. Therefore, the consumption of pure water and the like becomes larger. In this regard, this conventional processing is not preferable in terms of reprocessing and recycling efficiencies and in economic terms. In the respective processes to be performed in the substrate processing apparatus 1, various materials such as slurry, pure water, and a cleaning liquid are used, and used slurry and pure water and the like are also in various states after the respective processes. In view of this, it is preferable to separate or collect each liquid as discharged water in each process.

Therefore, there is still a pressing need for a substrate processing apparatus to collect, separate, process, recycle, and discard used slurry, used chemical liquids, used pure water, and other liquids.

The inventors have obtained the findings that, in the respective processes (mechanisms) "inside" a substrate processing apparatus, used slurry, used chemical liquids, used pure water, and other liquids can be instantly detected in water discharge lines, the used slurry, the used chemical liquids, the used pure water, and the other liquids can be appropriately collected in each process (mechanism) without mixing of these liquids and can be promptly and readily processed and separated, short water discharge lines can be used, physical separation means and filter/membrane separation means and the like can be omitted, and, consequently, processing, discarding, and recycling can be quickly and readily conducted at low costs.

That is, it is desirable to provide a water discharge system, a water discharge method, an apparatus that controls a water discharge apparatus, a control method, and a control program with which used slurry, used chemical liquids, used pure water, and other liquids can be quickly and readily collected, separated, processed, recycled, and discarded.

According to one embodiment, a water discharge system for a substrate processing apparatus comprising a substrate processor that processes a substrate using liquid, the water discharge system comprises: at least two water discharge lines capable of discharging the liquid used in the substrate processor; a switching device configured to switch a water discharge line to which the liquid used in the substrate processor is to be discharged among the at least two water discharge lines; a measurement device configured to generate water discharge information by measuring the liquid used in the substrate processor; and a control mechanism configured to control the switching device in accordance with the water discharge information.

According to another embodiment, a substrate processing apparatus comprises: a substrate processor configured to process a substrate using liquid; and the above water discharge system.

According to another embodiment, a water discharge method implemented in a substrate processing apparatus comprising a substrate processor that processes a substrate using liquid, the water discharge method comprises: generating water discharge information by measuring the liquid used in the substrate processor; determining to which one of at least two water discharge lines the liquid used in the substrate processor is to be discharged in accordance with the water discharge information, the at least two water discharge lines being provided in the substrate processing apparatus; and switching the water discharge line to which the liquid used in the substrate process is to be discharged among the at least two water discharge lines.

According to another embodiment, a water discharge control apparatus that controls water discharge from a substrate processor that processes a substrate using liquid, the water discharge control apparatus comprises: a determiner configured to determine to which one of at least two water discharge lines the liquid from the substrate processor is to be discharged in accordance with water discharge information about the liquid used in the substrate processor, the at least two water discharge lines being provided in a substrate processing apparatus; and an output module configured to output a control signal for controlling a switching device configured to switch the water discharge line to which the liquid is to be discharged among the at least two water discharge lines.

According to another embodiment, a water discharge control method for controlling water discharge from a substrate processor that processes a substrate using liquid, the water discharge control method comprises: determining to which one of at least two water discharge lines the liquid from the substrate processor is to be discharged in accordance with water discharge information about the liquid used in the substrate processor, the at least two water discharge lines being provided in a substrate processing apparatus; and outputting a control signal for controlling a switching device configured to switch the water discharge line to which the liquid is to be discharged among the at least two water discharge lines.

According to another embodiment, a non-transitory computer-readable medium storing a water discharge control program for controlling water discharge from a substrate processor that processes a substrate using liquid, the water discharge control program causing a computer to: determine to which one of at least two water discharge lines the liquid from the substrate processor is to discharged in accordance with water discharge information about the liquid used in the substrate processor, the at least two water discharge lines being provided in a substrate processing apparatus; and output a control signal for controlling a switching device configured to switch the water discharge line to which the liquid is to be discharged among the at least two water discharge lines.

Where a water discharge system is installed "inside" a substrate processing apparatus, and a system for automatically switching water discharge lines is employed, used slurry, used chemical liquids, used pure water, and other liquids can be quickly and readily discharged, and more importantly, can be quickly and readily separated or collected in each mechanism (process). Also, physical separation means and separation/collection means using filters and membranes can be omitted. Thus, a water discharge process that excels in speed and simplicity and in economic terms can be performed in a highly sophisticated manner.

BRIEF DESCRIPTION OF DRAWINGS

FIG. 10 is a diagram schematically showing the configuration of a water discharge system 101' according to a fourth embodiment;

FIG. 11 is a diagram schematically showing the configuration of a water discharge system 101" that is a modification of the system shown in FIG. 10;

FIG. 12 is a schematic perspective view of a cleaner 5;

FIG. 13 is a diagram schematically showing the configuration of a water discharge system 102 according to a fifth embodiment; and FIG. 14 is a diagram schematically showing the configuration of a water discharge system 102" that is a modification of the system shown in FIG. 13.

DETAILED DESCRIPTION

Figure 1:
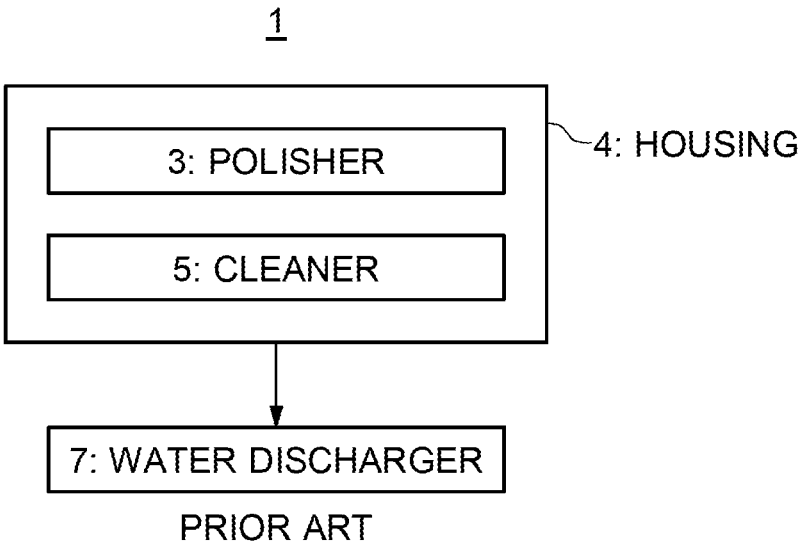
FIG. 1 is an explanatory diagram showing a water discharger of a conventional substrate processing apparatus.

According to one embodiment, a water discharge system for a substrate processing apparatus comprising a substrate processor that processes a substrate using liquid, the water discharge system comprises: at least two water discharge lines capable of discharging the liquid used in the substrate processor; a switching device configured to switch a water discharge line to which the liquid used in the substrate processor is to be discharged among the at least two water discharge lines; a measurement device configured to generate water discharge information by measuring the liquid used in the substrate processor; and a control mechanism configured to control the switching device in accordance with the water discharge information.

The water discharge information may include at least one of an amount of water to be discharged, a water discharge time, pH of the water to discharged, a number of articles in the water to be discharged, a degree of viscosity of the water to be discharged, and an electrical resistivity of the water to be discharged.

The water discharge system may further comprises a used liquid container configured to receive the liquid used in the substrate processor, wherein the at least two water discharge lines are connected to the used liquid container.

The water discharge system may further comprises a used liquid container configured to receive the liquid used in the substrate processor, wherein the at least two water discharge lines may comprise: a first water discharge line connected to the used liquid container; and at least two second water discharge lines connected to the first water discharge line.

The measurement device may be installed on at least one of the at least two water discharge lines.

The measurement device may be installed on the first water discharge line.

The measurement device may be installed inside the water discharge lines.

The water discharge system may be used in at least one of a substrate polishing process, a substrate cleaning process, an apparatus operation standby process, and a device cleaning process.

The control mechanism may control the switching device, when the water discharge information indicates a preset amount of water to discharged and a preset water discharge time, and that a pH value of the water to be discharged falls within a range of 6.0 to 8.0, a number of particles in the water to be discharged is outside a preset range, and a degree of viscosity of the water to be discharged is not lower than 0.88 mPa·s and not higher than 0.90 mPa·s (at 25° C.)

The switching device may be a valve.

The substrate processor may be a polisher configured to polish the substrate using slurry and pure water; and the at least two water discharge lines may comprise: a first water discharge line for the slurry; a second water discharge line for the pure water; and a third water discharge line for another liquid.

The water discharge system may further comprises a used liquid container configured to receive the slurry and the pure water used in the polisher, the used liquid container comprising a sloped bottom portion, wherein the first, second and third water discharge lines may be connected to the bottom portion of the used liquid container, a point at which the first water discharge line is connected to the bottom portion may be lower that points at which the second and third water discharge lines are connected to the bottom portion.

The substrate processor may be a cleaner configured to clean the substrate using pure water and chemical liquid; and the at least two water discharge lines may comprise: a first water discharge line for the pure water; and a second water discharge line for the chemical liquid.

The water discharge lines may comprise a collecting line and a recycling line; and the control mechanism may control the switching device, taking into account recyclability/non-recyclability determined based on the water discharge information.

According to one embodiment, a substrate processing apparatus comprises: a substrate processor configured to process a substrate using liquid; and the above water discharge system.

The substrate processing apparatus may further comprises a housing that houses the substrate processor, the water discharge lines in the water discharge system, the switching device, and the measurement device.

According to another embodiment, a water discharge method implemented in a substrate processing apparatus comprising a substrate processor that processes a substrate using liquid, the water discharge method comprises: generating water discharge information by measuring the liquid used in the substrate processor; determining to which one of at least two water discharge lines the liquid used in the substrate processor is to be discharged in accordance with the water discharge information, the at least two water discharge lines being provided in the substrate processing apparatus; and switching the water discharge line to which the liquid used in the substrate process is to be discharged among the at least two water discharge lines.

According to another embodiment, a water discharge control apparatus that controls water discharge from a substrate processor that processes a substrate using liquid, the water discharge control apparatus comprises: a determiner configured to determine to which one of at least two water discharge lines the liquid from the substrate processor is to be discharged in accordance with water discharge information about the liquid used in the substrate processor, the at least two water discharge lines being provided in a substrate processing apparatus; and an output module configured to output a control signal for controlling a switching device configured to switch the water discharge line to which the liquid is to be discharged among the at least two water discharge lines.

According to another embodiment, a water discharge control method for controlling water discharge from a substrate processor that processes a substrate using liquid, the water discharge control method comprises: determining to which one of at least two water discharge lines the liquid from the substrate processor is to discharged in accordance with water discharge information about the liquid used in the substrate processor, the at least two water discharge lines being provided in a substrate processing apparatus; and outputting a control signal for controlling a switching device configured to switch the water discharge line to which the liquid is to be discharged among the at least two water discharge lines.

According to another embodiment, a non-transitory computer-readable medium storing a water discharge control program for controlling water discharge from a substrate processor that processes a substrate using liquid, the water discharge control program causing a computer to: determine to which one of at least two water discharge lines the liquid from the substrate processor is to be discharged in accordance with water discharge information about the liquid used in the substrate processor, the at least two water discharge lines being provided in a substrate processing apparatus; and output a control signal for controlling a switching device configured to switch the water discharge line to which the liquid is to be discharged among the at least two water discharge lines.

The following is a description of embodiments.

Figure 2:
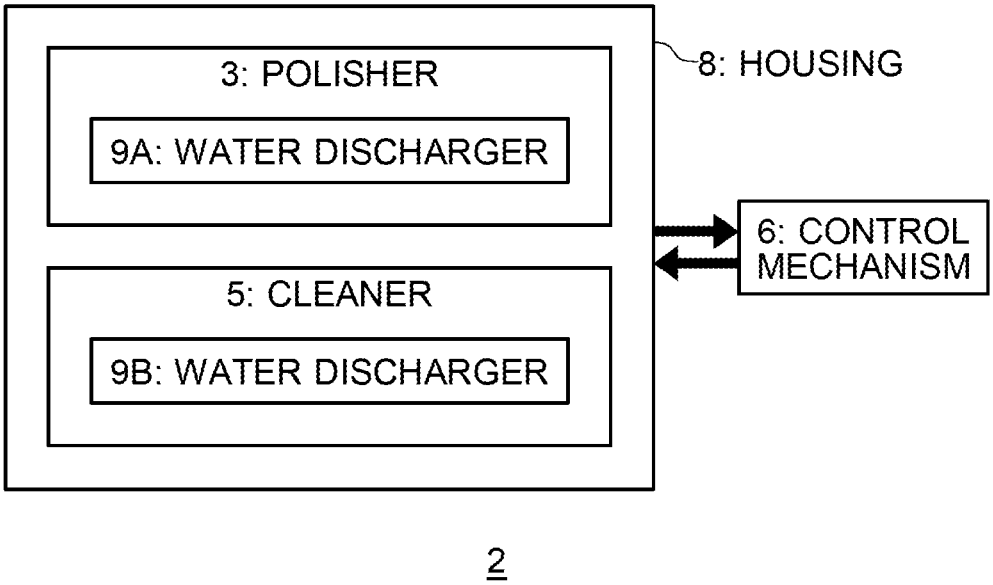
FIG. 2 is a block diagram schematically showing the configuration of a substrate processing apparatus 2.

FIG. 2 is a block diagram schematically showing the configuration of a substrate processing apparatus 2. The substrate processing apparatus 2 includes a polisher 3 that includes a water discharger 9A, a cleaner 5 that includes a water discharger 9B, a housing 8 that houses these components, and a control mechanism 6 that controls the water dischargers 9A and 9B. The embodiments described below are applied in cases where a polishing process is performed on a semiconductor wafer (hereinafter also referred to simply as a wafer).

As described above, the water dischargers 9A and 9B are incorporated into the substrate processing apparatus 2 and are used. Therefore, unlike the water discharger 7 (FIG. 1) installed "outside" the conventional substrate processing apparatus 1, the water dischargers 9A and 9B are used "inside" the substrate processing apparatus 2 as shown in FIG. 2. The water dischargers 9A and 9B are preferably installed inside the polisher 3 and the cleaner 5, respectively, as shown in FIG. 2. Alternatively, the water dischargers 9A and 9B may be installed outside the polisher 3 and the cleaner 5 but inside the housing 8.

The polisher 3 and the water discharger 9A will be described below in first through fourth embodiments, and the cleaner 5 and the water discharger 9B of the cleaner 5 will be described below in a fifth embodiment.

First Embodiment

Figure 3:
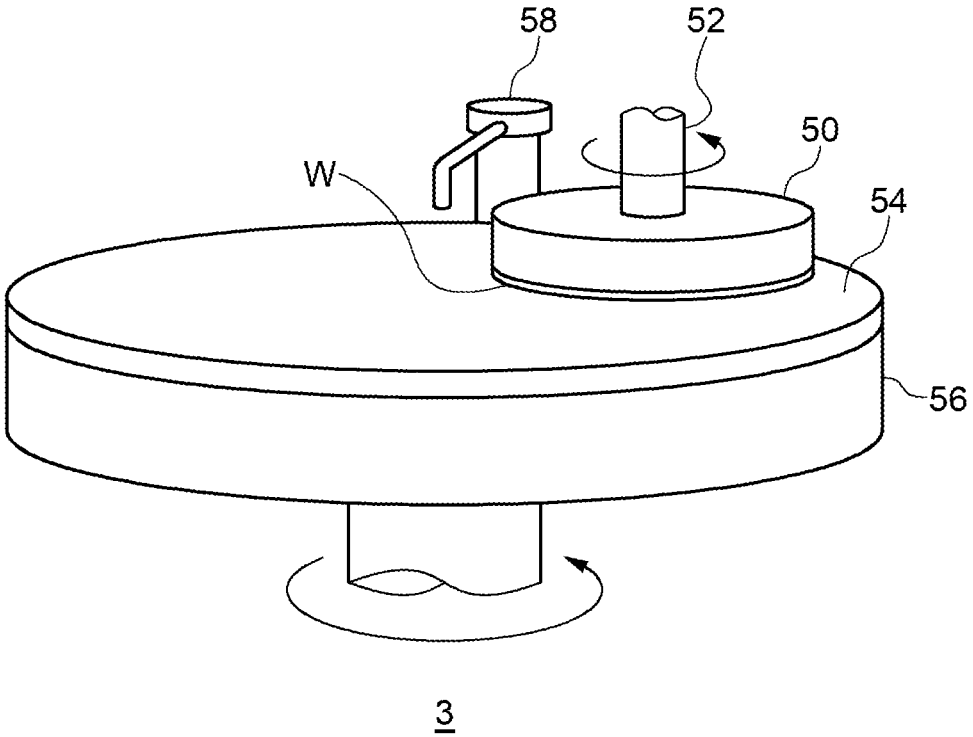
FIG. 3 is a schematic perspective view of a polisher 3 of the substrate processing apparatus 2.

FIG. 3 is a schematic perspective view of a polisher 3. The polisher 3 is an example of a substrate processor, and includes a top ring 50, a top ring shaft 52, a polishing table 56, and a nozzle 58.

The top ring 50 is supported by the top ring shaft 52, holds a wafer W by vacuum contact, and polishes the wafer W while pressing the wafer W against a polishing pad 54 on the polishing table 56. The polishing pad 54 is bonded to the upper surface of the polishing table 56, and the upper surface of the polishing pad 54 forms the polishing surface that polishes the wafer W. The top ring 50 and the polishing table 56 are designed to rotate about the shaft centers thereof, as indicated by arrows.

The nozzle 58 supplies slurry and pure water onto the polishing pad 54. Slurry is used as a polishing liquid, and pure water is used as a polishing liquid or a dressing liquid.

Although not shown in the drawing, the polisher 3 also includes a dresser for dressing the polishing pad 54, and an atomizer (not shown) that atomizes a fluid mixture of a liquid (pure water, for example) and a gas (a nitrogen gas, for example), or a liquid (pure water, for example), and sprays the atomized fluid mixture or liquid onto the polishing surface.

In substrate polishing, a wafer is normally subjected to: 1) slurry polishing (process/mechanism) in which the substrate surface (meaning the wafer or a film or the like on the wafer) is polished with slurry; 2) pure water cleaning/polishing (process/mechanism) in which the substrate is cleaned (polished) with pure water (or DIW); 3) dressing (process/mechanism) in which the polishing pad 54 is shaved with the dresser; and 4) atomizing (process/mechanism) in which the grinding sludge or abrasive grains remaining on the polishing surface of the polishing pad 54 after the dressing process is cleaned (washed off) as necessary. A water discharge system according to this embodiment is used in these processes and mechanisms.

Here, the slurry is rarely neutral, and acidic slurry or alkaline slurry is used depending on the purpose of use, or particularly, depending on the material that is formed on the substrate surface and is to be polished. For example, in a case where a metallic film of copper wiring or the like is polished, acidic slurry is often used. In a case where an insulating film such as an oxide film is polished, alkaline slurry is often used.

Used slurry or pure water may contain grinding sludge (particles) of the polishing pad 54 or the substrate surface.

That is, the polisher 3 discharges acidic or alkaline slurry, pure water or slurry containing particles, pure water containing no particles, a chemical liquid, or the like.

Therefore, in this embodiment, these discharged liquids are appropriately separated by the water discharge system described below.

Figure 4:
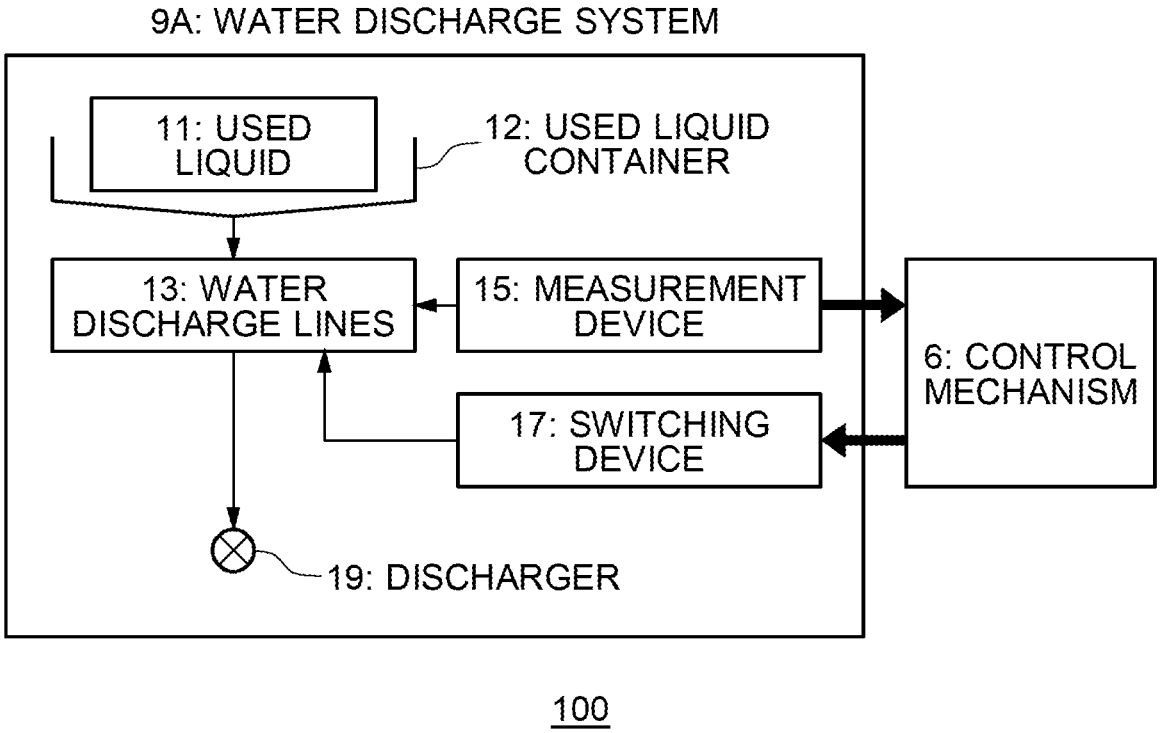
FIG. 4 is a diagram schematically showing the configuration of a water discharge system 100 according to a first embodiment.

FIG. 4 is a diagram schematically showing the configuration of a water discharge system 100 according to a first embodiment. The water discharge system 100 is formed with a water discharger 9A and a control mechanism 6. The control mechanism 6 may be installed inside the housing 8, or may be installed outside the housing 8.

As shown in the schematic diagram in FIG. 4, the water discharger 9A according to this embodiment includes a used liquid container 12, two or more water discharge lines 13, a measurement device 15, a switching device 17, and a discharger 19.

When a used liquid 11 used by the polisher 3 of the substrate processing apparatus 2 is discharged, the two or more water discharge lines 13 can discharge the used liquid 11 to the outside of the substrate processing apparatus 2. The switching device 17 switches between the two or more water discharge lines 13, to which water is to be discharged. The measurement device 15 measures water discharge information. In accordance with results of measurement carried out by the measurement device 15, the control mechanism 6 controls the switching device 17.

In the water discharge system 100, the discharger 19 discharges used water so that the discharged water is separated or collected in the end.

Figure 5:
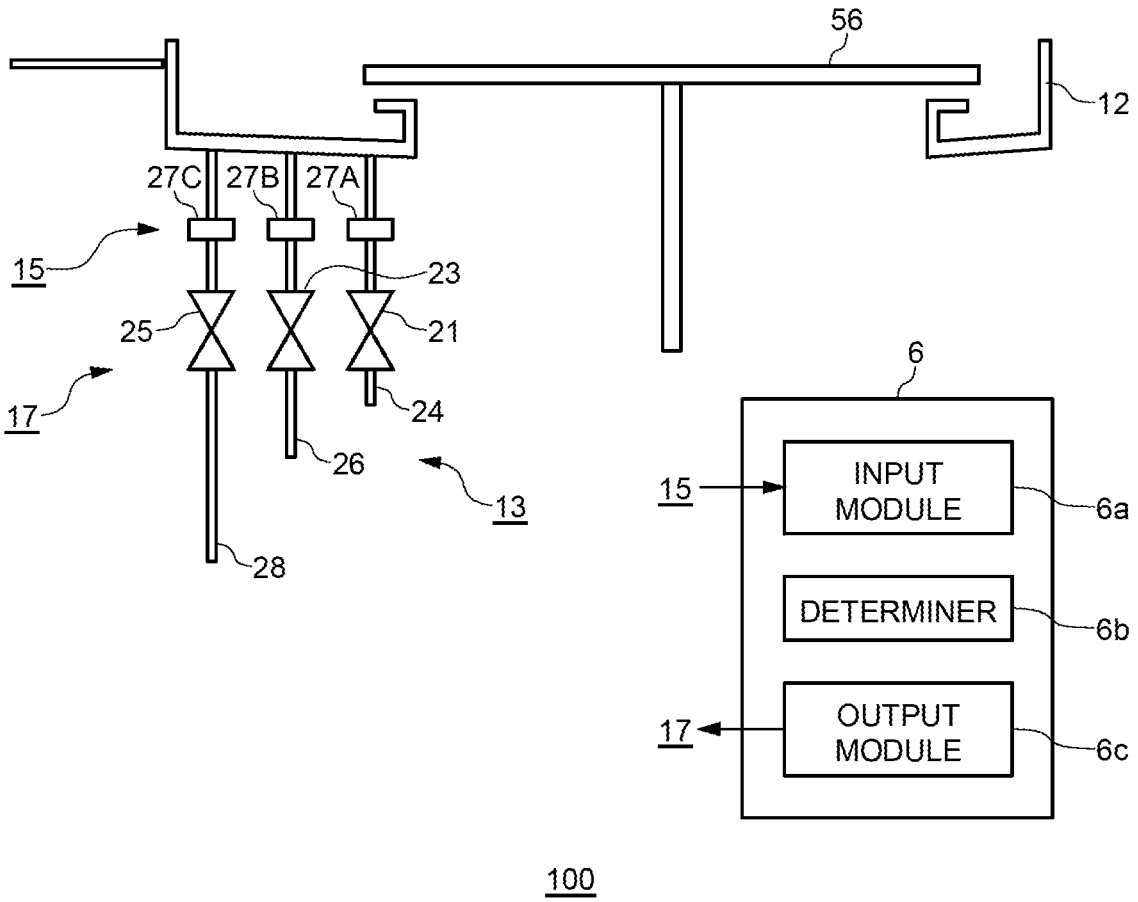
FIG. 5 is a diagram for explaining the water discharge system 100 in greater detail.

FIG. 5 is a diagram for explaining the water discharge system 100 in greater detail. As shown in FIG. 5, the used liquid container 12, the water discharge lines 13, the switching device 17, and the measurement device 15 in the water discharger 9A can be configured as described below.

Used Liquid Container 12

As shown in FIG. 5, the water discharger 9A includes the used liquid container 12 that receives the used liquid 11 used in the substrate processing apparatus 2.

The used liquid container 12 is a waste pan that is provided around and under the polishing table 56 shown in FIG. 4, and collects used water (the used liquid 11). The used liquid container 12 may be in a ring-like form, and, in that case, the shaft for rotating the polishing table 56 penetrates through the hollow at the center of the used liquid container 12.

As described above, the used liquid 11 contains acidic or alkaline slurry. Therefore, the used liquid container 12 may be made of any appropriate material such as a metal or reinforced plastic, as long as the material has durability and does not cause a chemical reaction with any used water. To facilitate used water collection, the used liquid container 12 preferably has a sloped bottom portion. For example, the bottom portion of the used liquid container 12 may be sloped so that the center of the bottom portion is located lower than the outer circumference of the bottom portion.

With this, used water with a high specific gravity, such as slurry, easily sinks to the bottom portion. Thus, such used water can be discharged, and be separated or collected.

Water Discharge Lines 13

The two or more water discharge lines 13 are connected to the bottom portion of the used liquid container 12. The specific number of the water discharge lines 13 can be appropriately determined in accordance with the type of water discharge. Since polishing is performed with slurry and pure water in this embodiment, three water discharge lines 24, 26, and 28 will suffice. The three water discharge lines are a water discharge line 24 for used slurry, a water discharge line 28 for used pure water, and a water discharge line 26 for some other liquid. The conditions for discharging used water, and an increase/decrease in the number of the water discharge lines 13 may be determined as appropriate, with the cost efficiency of the water discharger 9A being taken into account.

"Used slurry" has been used as slurry, and primarily contains slurry components after polishing. "Used pure water" has been used as pure water after polishing or cleaning, and is substantially pure water. "Some other liquid" is a liquid that cannot be classified as used slurry or used pure water but contains slurry components or particles such as grinding sludge, or is a liquid that belongs neither to used slurry nor to used pure water but primarily serves as a chemical liquid.

In a case where the bottom portion of the used liquid container 12 is sloped, the water discharge line 24 for slurry is preferably connected to the lowest position, because slurry has a higher specific gravity than pure water.

The water discharge lines 13 may be made of any appropriate material of any shape, such as a metal or reinforced plastic, as long as the material has durability and does not cause a chemical reaction with any used water. For ease of installation, however, the water discharge lines 13 are preferably made of a flexible material.

Measurement Device 15, or Measurement Devices 27A Through 27C

In a preferred mode, the measurement device 15 is installed on at least one of the two or more water discharge lines 24, 26, and 28. Alternatively, the measurement device 15 may be installed inside the water discharge lines 24, 26, and 28.

The measurement device 15 may be installed on each of the water discharge lines 24, 26, and 28. In the example illustrated in FIG. 5, a measurement device 27A is provided on the water discharge line 24 for used slurry, a measurement device 27C is provided on the water discharge line 28 for used pure water, and a measurement device 27B is provided on the water discharge line 26 for some other liquid. As the switching device 17 is to be controlled in accordance with results of measurement carried out by the measurement devices 27A through 27C, the measurement devices 27A, 27B, and 27C are preferably installed at sites located above the switching device 17. Such sites are located on the upstream side of the switching device 17.

In a preferred mode, at least the measurement device 27B is preferably installed on the water discharge line 26 that collects some other liquid. In a case where the measurement device 27B determines that the used water flowing in the water discharge line 26 is used slurry or used pure water, the former can be discharged through the water discharge line 24, and the latter can be discharged through the water discharge line 28. Accordingly, the single measurement device 27B can readily separate used water, and, as a result, the used water can be discharged and be then separated or collected efficiently at low costs.

The measurement device 15 measures water discharge information designed for determining whether the used water to be measured should be discharged as used slurry, whether the used water to be measured should be discharged as used pure water, and whether the used water to be measured should be discharged as some other liquid. In a preferred mode, the measurement device 15 measures information about used water, which is physical-chemical information about used water. Specifically, the measurement device 15 may be a pH sensor that measures pH of used water, a particle counter that counts the number of particles in used water, a viscometer that measures the degree of viscosity of used water, or a resistance meter that measures the electrical resistivity (specific resistance) of used water. The measurement device 15 also measures the amount of used water to be discharged, or the discharge time for the used water. Normally, a product available on the market can be used as the measurement device 15. As a particle counter that counts the number of particles in used water, RION KL-30A (model number), manufactured by RION Co., Ltd., can be used, for example. As a pH sensor, an in-line pH meter can be used, for example. As a viscometer, an in-line viscometer that utilizes ultrasonic oscillation can be used, for example. As an electrical resistivity meter (a specific resistance meter), an industrial specific resistance meter (HE-480R), manufactured by HORIBA, Ltd., can be used, for example.

The water discharge information indicating the results of used water measurement carried out by the measurement devices 27A, 27B, and 27C is inputted to the control mechanism 6.

Switching Device 17

In this embodiment, the number of the water discharge lines 13 may be the same as the number of switching devices 17. That is, in this embodiment, valves 21, 23, and 25 are provided as the switching devices 17 on the water discharge lines 24, 26, and 28, respectively. When the valve 21 is in an opened state, used water can pass through the water discharge line 24. When the valve 21 is in a closed state, used water cannot pass through the water discharge line 24. The same applies to the valves 23 and 25. The opened/closed states of the valves 21, 23, and 25 are controlled by the control mechanism 6.

Control Mechanism 6

In accordance with the water discharge information inputted from the measurement device 15 and water discharge information inputted in advance, the control mechanism 6 controls an instruction as to switching between the switching devices 17. In a preferred mode, the control mechanism 6 controls the switching devices 17, when the numerical values measured by the measurement device 15 indicate a preset amount of used water to be discharged and a preset discharge time for the used water, and that the pH value of the used water falls within the range of 6.0 to 8.0, the number of particles in the used water is outside a preset range, and the degree of viscosity of the used water is not lower than 0.88 mPa·s and not higher than 0.90 mPa·s (at 25° C.)

In a specific example configuration, the control mechanism 6 includes an input module 6*a*, a determiner 6*b*, and an output module 6*c*. These components (or at least one of these components) may be achieved by a processor of a computer executing a predetermined program, or may be mounted in hardware.

Results of measurement carried out by the measurement device 15 are inputted as the water discharge information to the input module 6*a*. That is, the water discharge information measured by the measurement device 15 may be transmitted in real time to the input module 6*a* through an information transmission module (not shown). Specifically, information about used water is measured through the measurement device 15, and signals regarded as the measurement information about the used water are inputted to the input module 6*a*. Thus, the input module 6*a* obtains the information.

In accordance with the water discharge information, the determiner 6*b* determines to which one of the water discharge lines 13 the used water from the polisher 3 should be discharged, or, in other words, determines how to control the switching devices 17. Specifically, in accordance with the water discharge information, the determiner 6*b* may calculate consistency between the water discharge information and the Preset water discharge information, and determine a discharge line in accordance with a result of the calculation. The measurement information about used water is inputted in real time, and therefore, the accumulation time of the information may be several minutes or several seconds. The preset water discharge information may be determined as appropriate, but is Preferably determined in conformity with the processing procedures (recipe) to be carried out by the substrate processing apparatus 2.

The output module 6*c* outputs a control signal for controlling the switching devices 17, and, in accordance with a determination result, controls the switching devices 17 (that is, by opening or closing the valves 21, 23, and 25). In accordance with this control signal, the opened/closed states of the valves 21, 23, and 25 installed on the water discharge lines 24, 26, and 28 are controlled, so that a desired water discharge line is selected, and used water can be discharged through the selected water discharge line.

Figure 6:
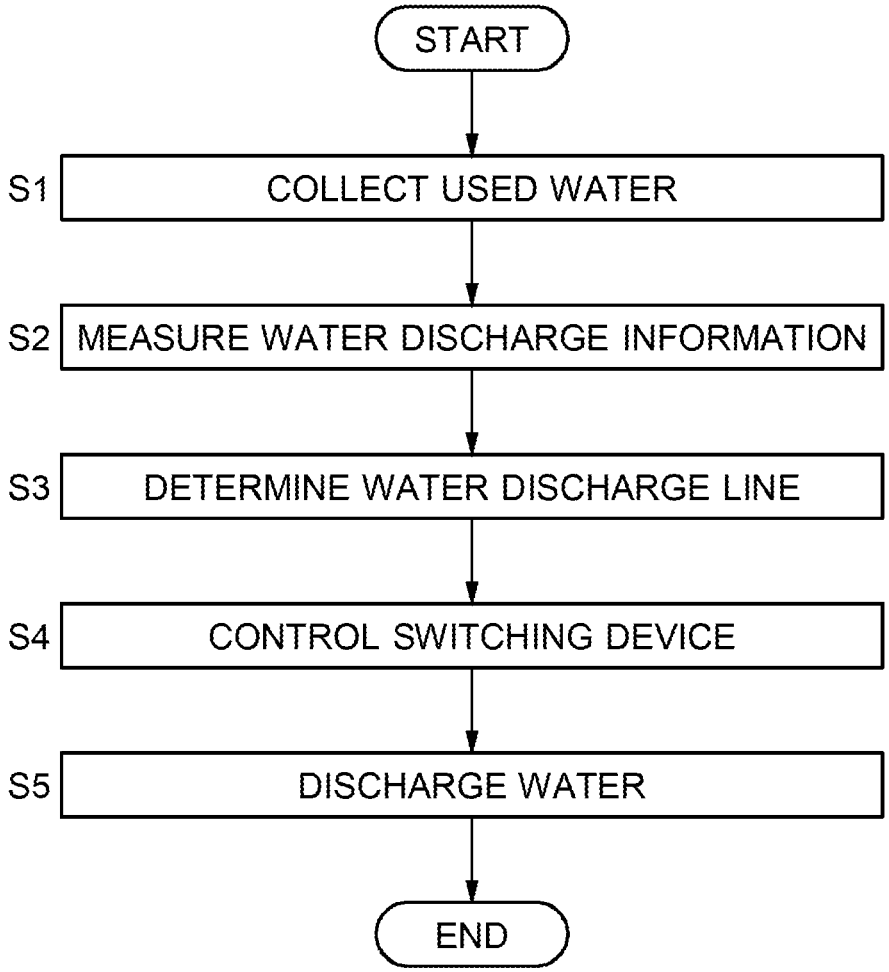
FIG. 6 is a flowchart showing a processing operation to be performed by the water discharge system 100.

FIG. 6 is a flowchart showing a processing operation to be Performed by the water discharge system 100. Through this process, the used liquid 11 as one of the three kinds of water, which are used slurry, used pure water, and some other liquid, is appropriately discharged through one of the three water discharge lines 24, 26, and 28. In the flowchart, "S" is the first letter of the word "step" (hereinafter, this will also apply in this specification). As shown in FIG. 6, a water discharge method in the substrate processing apparatus 2 according to this embodiment includes: (S1) the used liquid container 12 collecting used water from the polisher 3; (S2) the measurement device 15 measuring water discharge information, and inputting the result to the input module 6*a* in the control mechanism 6; (S3) the determiner 6*b* in the control mechanism 6 analyzing the result of the measurement carried out by the measurement device 15, and determining to which one of the water discharge lines 24, 26, and 28 the used water is to be discharged; (S4) the output module 6*c* in the control mechanism 6 outputting a control signal for controlling the switching device 17, in accordance with a result of the determination; and (S5) the selected water discharge line discharging the used water.

In the description below, an example case where the measurement device 15 includes a pH sensor and a particle counter is explained. In this case, in (S2), the pH of the used water and the number of particles measured and counted by the respective measurement devices 15 are inputted to the input module 6*a*.

In (S3), if the pH is within the preset range (6 to 8, for example), and the number of particles is equal to or smaller than the preset number (several tens of particles having Particle sizes equal to or larger than the detection limits, per milliliter, for example), the determiner 6*b* determines that the used water is to be discharged to the water discharge line 28 for used pure water. In this case, in (S4), the output module 6*c* opens the valve 25 installed on the water discharge line 28, and closes the other valves 21 and 23. With this, pure water that hardly contains slurry and particles can be recovered.

If is outside the preset range in (S3), or if the number of particles is not the preset number, the determiner 6*b* determines that the used water is to be discharged to the water discharge line 26 for some other liquid. In this case, in (S4), the output module 6*c* opens the valve 23 installed on the water discharge line 26, and closes the other valves 21 and 25. Thus, liquid containing particles can be prevented from entering the water discharge line 24 for used slurry, and liquid containing slurry and particles can be prevented from entering the water discharge line 28 for used pure water.

This water discharge technique is suitable for substrate polishing with water (a process/mechanism), dressing (a process/mechanism), standing by for apparatus operation (a process/mechanism), or device cleaning (a process/mechanism). Here, standing by for apparatus operation is a state where the substrate processing apparatus 2 temporarily suspends its operation and enters a standby state during installation, conveyance, or the like of an object being processed in the polisher 3. To maintain the apparatus operation state in such a case, pure water or the like is made to flow so as to prevent the polishing pad 54 and the top ring 50 from becoming dry. Device cleaning is cleaning not for substrate polishing or cleaning, which is the original purpose, but is performed to clean the top ring 50, the wafer conveying means, the dresser, the nozzle 58, the atomizer, and the like in the substrate processing apparatus 2. In the device cleaning, a large amount of pure water is also used. Thus, even in such a device cleaning step, the water discharge system 100 can reuse the collected/recycled water as pure water.

Next, an example case where the measurement device 15 measures a water discharge time is described. In the substrate processing apparatus 2, procedures for processing a substrate and conditions for the processing (called a "recipe") are normally set to operate the apparatus. In this recipe, a polishing time is determined from the preset number of seconds in the polishing process or from the end point of the polishing Process. Therefore, if a water discharge time can be set in advance, used slurry and the like can be effectively separated or collected.

In this case, in (S2), a relationship between the timings to start and end polishing with slurry (these times are set in the recipe) and the water discharge time is inputted.

In (S3), if the water discharge time is within a Predetermined time (10 seconds, for example) from the start of polishing, or within a predetermined time (10 seconds, for example) before the end of polishing (or after detection of the end point), the determiner 6*b* determines that the used water is to be discharged to the water discharge line 26 for some other liquid. Since slurry contains a large amount of grinding sludge immediately after the start and immediately before the end of polishing, water discharge is preferably performed at such timing, for example.

In (S3), if the water discharge time is after the predetermined time from the start of polishing, or before the predetermined time before the end of polishing (or before detection of the end point), on the other hand, the determiner 6*b* determines that the used water is to be discharged to the water discharge line 24 for used slurry. This is because, after a certain time has passed since the start of polishing, the used water hardly contains grinding sludge.

Such a water discharge technique is suitable particularly in substrate polishing with slurry (a process/mechanism).

Such a water discharge technique can be used not only in substrate polishing, dressing, standing by for apparatus operation, and device cleaning, but also in various processing steps (mechanisms) in which used water is generated.

The above described water discharge technique is merely an example. Water discharge may be performed in accordance only with the pH value or the number of particles. Alternatively, water discharge may be performed in accordance with a combination of results of different kinds of measurement. For example, amounts of use and durations of use are set beforehand for slurry, cleaning chemical liquid, and pure water, and actual amounts of use and actual durations of use (including the time required for passing through a water discharge line) are measured with the measurement devices 15 on the water discharge lines 13. The control mechanism 6 then issues a switching instruction to the switching devices 17, so that the used water can be discharged through a desired water discharge line 13, and be then separated or collected. Also, the degree of viscosity, the number of particles, the pH, and the ion concentration in the used water passing through the water discharge lines 13 are measured with the measurement devices 15, are subjected to arithmetic processing, and are determined in accordance with preset water discharge information. In accordance with the results of the determination, the control mechanism 6 issues a switching instruction to the switching devices 17, so that the used water can be discharged to the respective water discharge lines 13, and be then separated or collected.

As described above, in the first embodiment, used water from the polisher 3 can be separated or collected as used slurry, used pure water, and other liquids. That is, as used slurry, used pure water, and other liquids can be appropriately discharged, and be separated or collected, at least part or all of physical separation means and filter/membrane separation means can be omitted in reprocessing and recycling slurry, pure water, and the like. Thus, a discharged water separation/correction process can be quickly and readily performed. However, at the time of recycling of discharged water, physical separation means and filter/membrane separation means are not necessarily eliminated. Instead, physical separation means and filter/membrane separation means may be further employed so that the quality of recycled water can be maintained at a preferred level at the time of recycling.

Also, where used water separation and collection can be conducted inside the substrate processing apparatus 2, the sum of the lengths of the water discharge lines can be made smaller than that in a case where used water separation and collection is conducted outside the apparatus. Also, contaminated materials hardly adhere to the inside of each water discharge line, but can be efficiently discharged, and be separated or collected. Further, a used cleaning chemical liquid can be quickly and readily collected, and be easily discarded, for example.

Second Embodiment

In the first embodiment described above, the three water discharge lines 24, 26, and 28 are connected to the bottom Portion of the used liquid container 12. In the second embodiment described below, on the other hand, a main water discharge line is connected to the bottom portion of the used liquid container 12, and three water discharge lines are connected to the main water discharge line.

Figure 7:
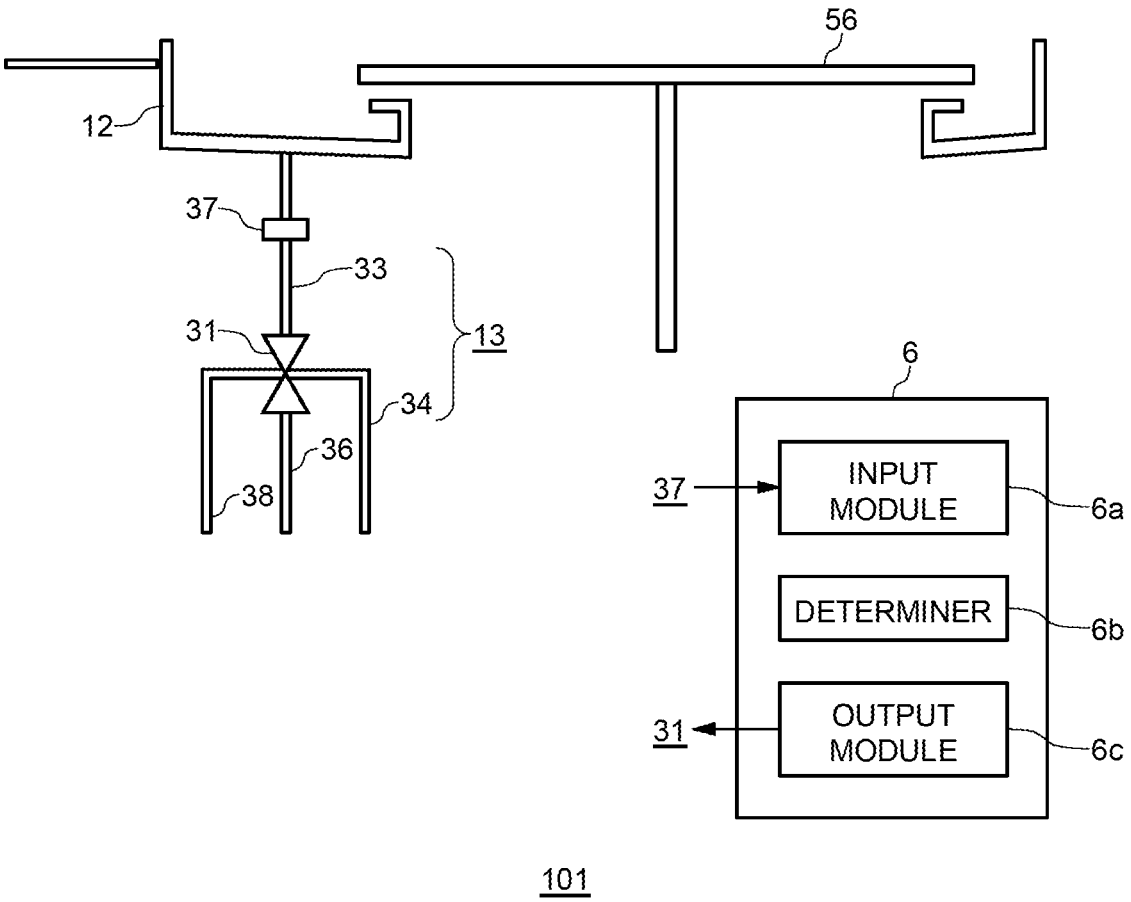
FIG. 7 is a diagram schematically showing the configuration of a water discharge system 101 according to a second embodiment.

FIG. 7 is a diagram schematically showing the configuration of a water discharge system 101 according to the second embodiment. This water discharge system 101 includes two or more water discharge lines 13, which are a main water discharge line 33 and two or more water discharge lines (sub water discharge lines) 34, 36, and 38 connected to the main water discharge line 33. The water discharge system 101 also includes a variable valve 31 as a switching device 17. The upper portion of the main water discharge line 33 is connected to the bottom portion of the used liquid container 12, and the lower portion of the main water discharge line 33 is connected to the variable valve 31. The water discharge lines 34, 36, and 38 are connected to the main water discharge line 33 via the variable valve 31. Under the control of the control mechanism 6, the variable valve 31 switches among the water discharge lines 34, 36, and 38, to which used water from the main water discharge line 33 is to be introduced. Further, a measurement device 37 is installed on the main water discharge line 33.

It is preferable to employ the main water discharge line 33 connected to the used liquid container 12, and dispose the two or more water discharge lines 34, 36, and 38 under the main water discharge line 33 as described above. This is because the single measurement device 37 will suffice, and used water can be appropriately separated. Thus, cost efficiency and simplicity can be achieved. It should be noted that, in this embodiment, all the water discharge lines 34, 36, and 38 may also be equipped with switching devices 17 and measurement devices 15.

The other aspects of the configuration and the processing operation are the same as those of the first embodiment.

As described above, in the second embodiment, the used water collected in the used liquid container 12 passes through the main water discharge line 33 once. Therefore, only one measurement device 15 is installed on the main water discharge line 33. As only one measurement device 37 and only one variable valve 31 are required, device installation is minimized, which is advantageous in economic terms.

Third Embodiment

In the first and second embodiments described above, the emphasis is on discharge of used water through an appropriate water discharge line. The third embodiment described below is a modification of the first embodiment. In the third embodiment, when the results of measurement satisfy predetermined conditions, used water is not collected but is recycled. In the description below, the differences from the first embodiment will be mainly explained.

Figure 8:
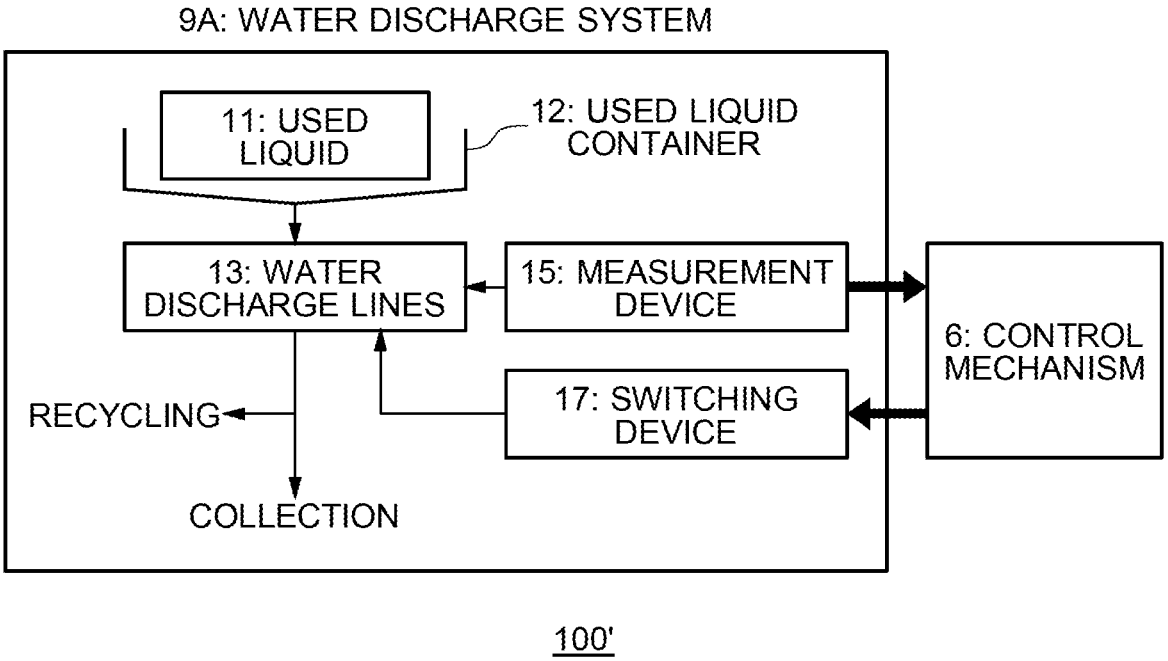
FIG. 8 is a diagram schematically showing the configuration of a water discharge system 100' according to a third embodiment.

FIG. 8 is a diagram schematically showing the configuration of a water discharge system 100' according to the third embodiment. As shown in the drawing, a switching device 17 switches between discharge from a water discharge line 13 and recycling.

Figure 9:
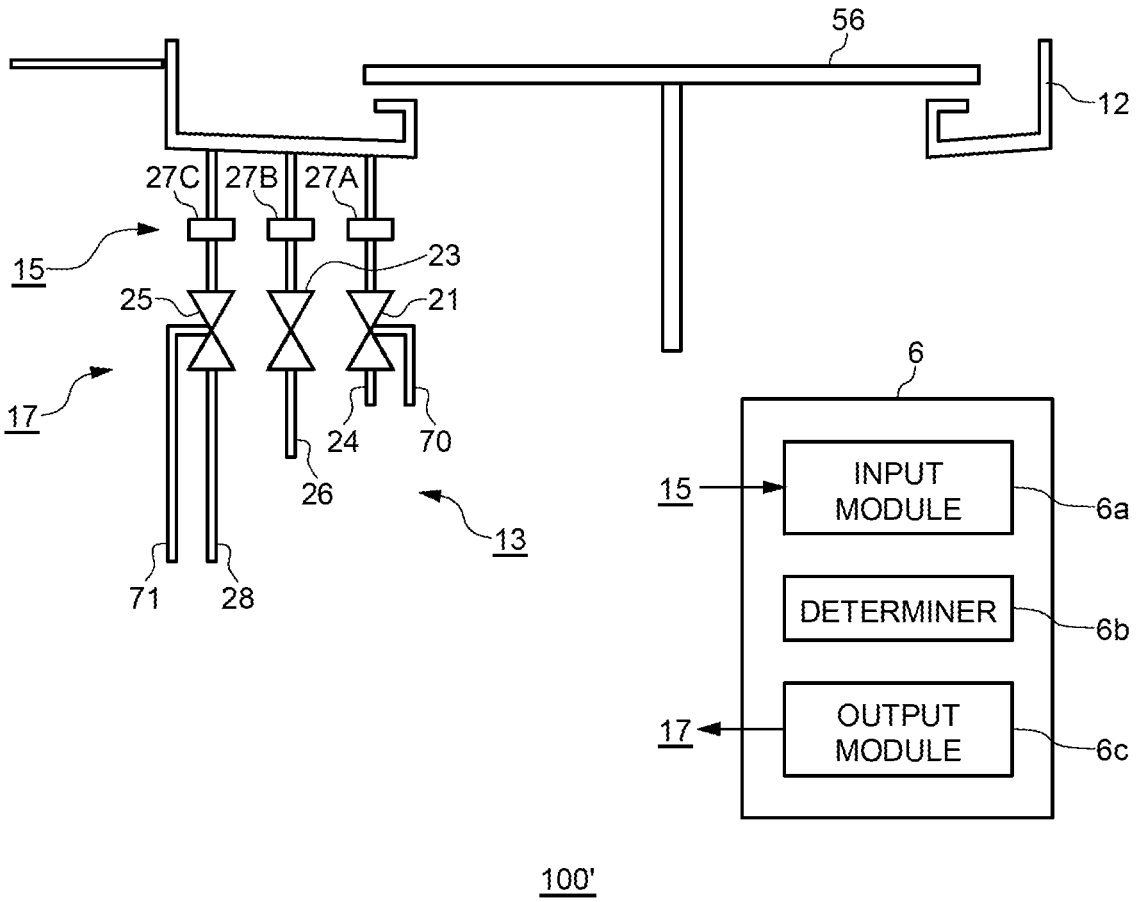
FIG. 9 is a diagram for explaining the water discharge system 100' in greater detail.
Figure 1:
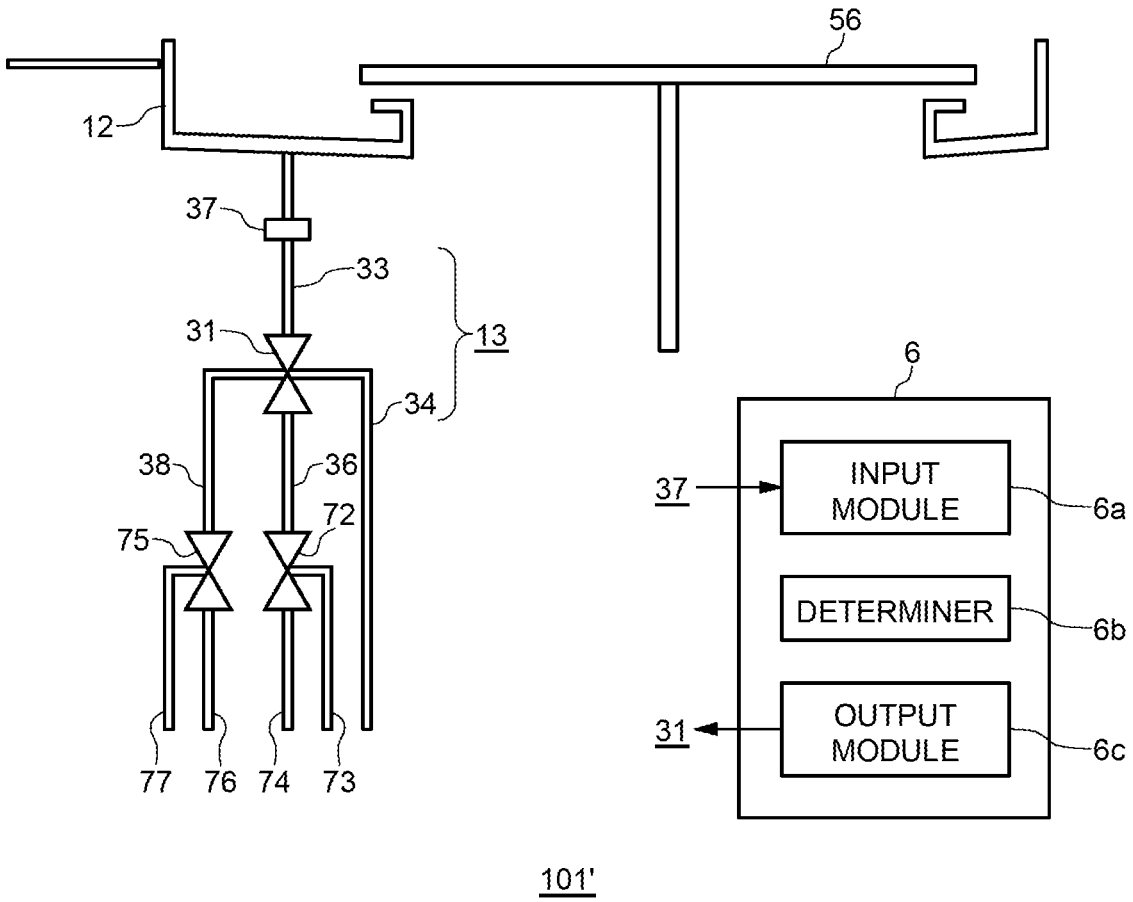
Figure 1:
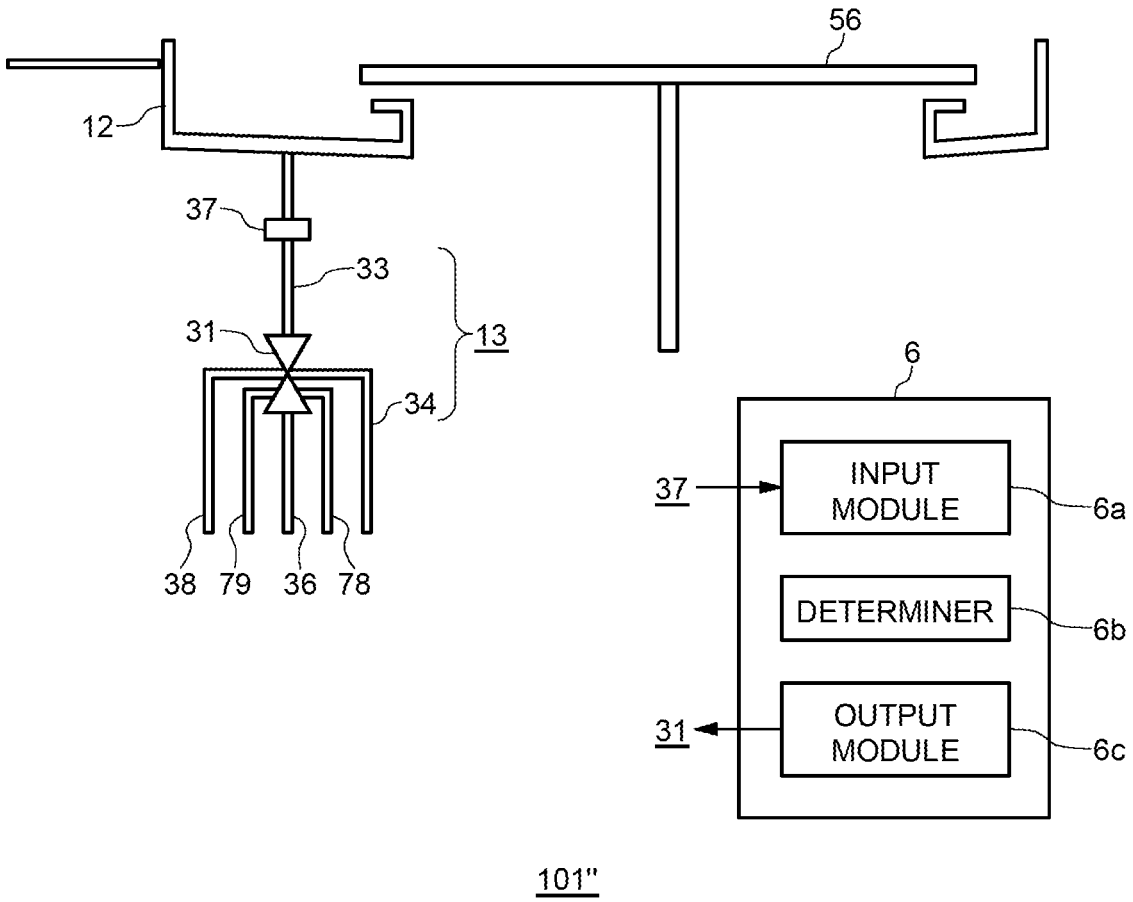
Figure 1:
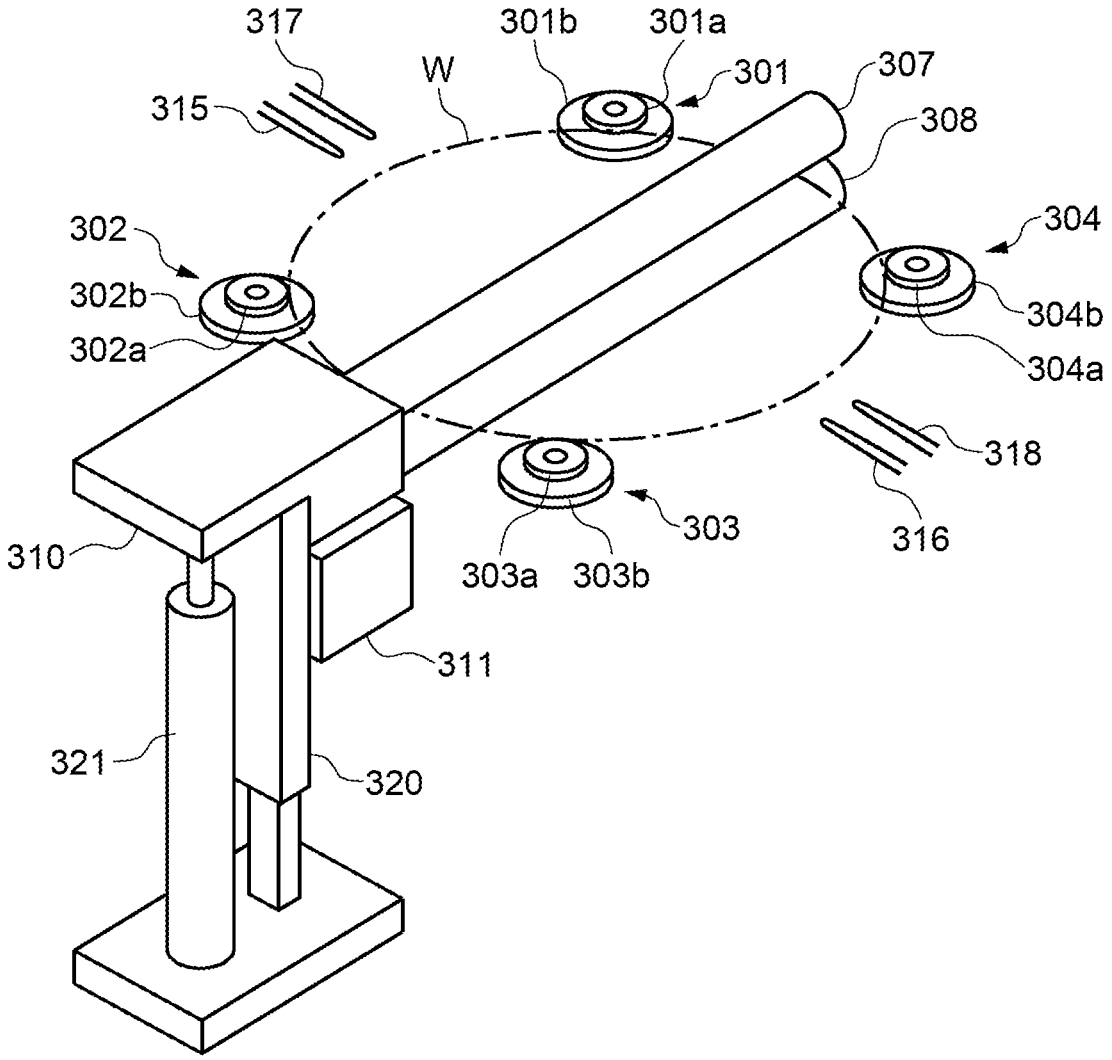
Figure 1:
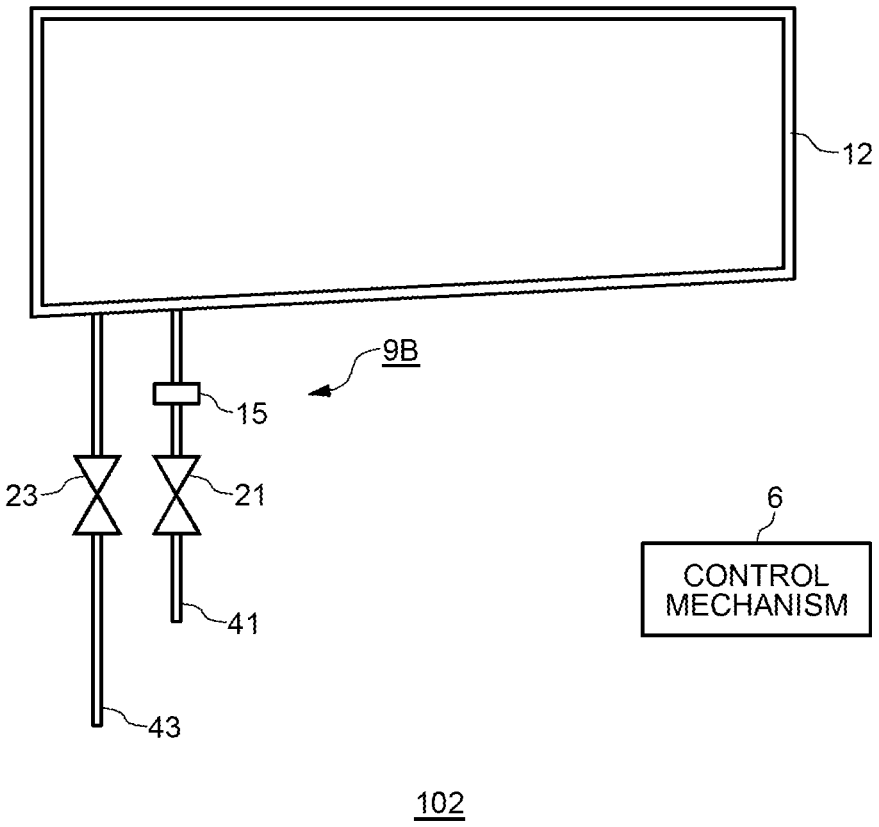
Figure 1:
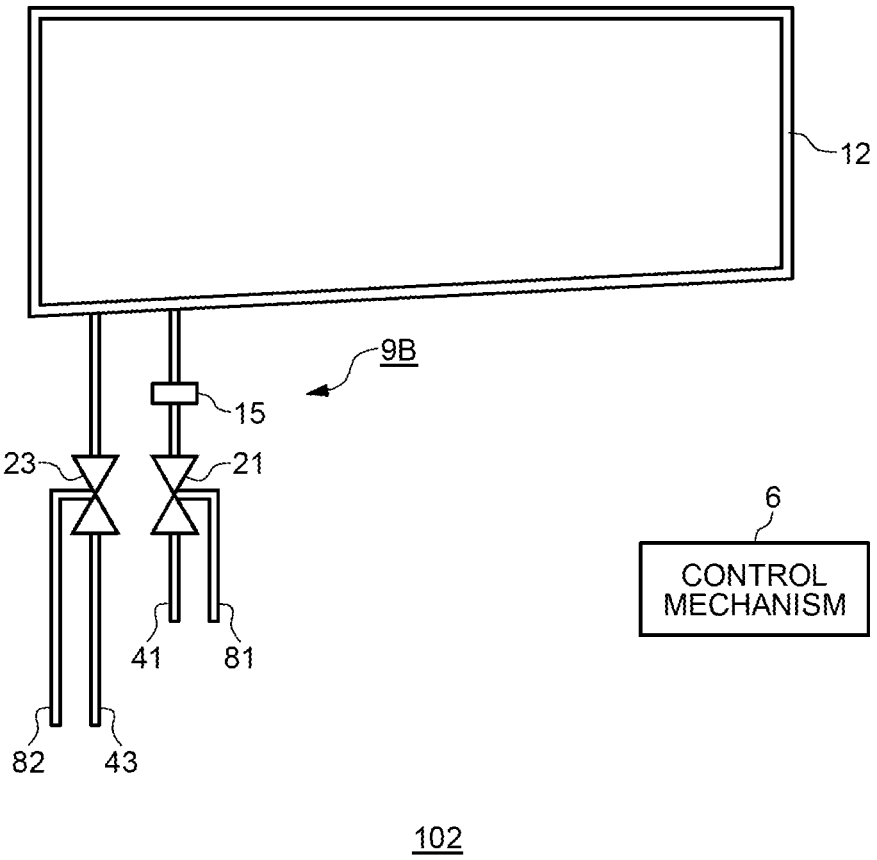

FIG. 9 is a diagram for explaining the water discharge system 100' in greater detail. As the water discharge lines 13, a water discharge line 70 for recycling used slurry and a water discharge line 71 for recycling used pure water are provided, in addition to water discharge lines 24, 26, and 28 for discharging used water to the outside and then collecting the used water. The water discharge lines 24, 26, and 28 can be called collecting lines, and the water discharge lines 70 and 71 can be called recycling lines.

A valve 21 switches between the water discharge lines 24 and 70, through which used slurry is to be discharged. A valve 25 switches between the water discharge lines 28 and 71, through which used pure water is to be discharged. It should be noted that "some other liquid" is often a chemical liquid or the like. In the polisher 3, however, abrasive grains remain on the polishing pad 54 and are diluted with water. Therefore, if it is difficult to recycle "some other liquid", a water discharge line for recycling this liquid does not need to be prepared.

A processing operation to be performed by the water discharge system 100' is substantially the same as that shown in FIG. 6, except that, in step S3, a determiner 6*b* determines to which one of the water discharge lines 24, 26, 28, 70, and 71 the used water is to be discharged, in accordance with measurement results. More specifically, in accordance with results of measurement carried out by measurement devices 27A through 27C, the determiner 6*b* determines not only the type of the used water (slurry, pure water, or some other liquid such as a chemical liquid), but also whether it is possible to recycle the used water. For example, the determiner 6*b* compares the pH of the used water, the number of particles in the used water, the degree of viscosity of the used water, and the like with predetermined threshold values, and then determines whether it is possible to recycle the used water. In accordance with the results of the determination, the switching devices 17 (the valves 21, 23, and 25) are controlled. For example, if the used water is recyclable slurry, the valves 21, 23, and 25 are switched so that the used water is introduced to the water discharge line 70.

Fourth Embodiment

The fourth embodiment described below is the same as second embodiment, except for including recycling lines. In the description below, the differences from the first through third embodiments will be mainly explained.

FIG. 10 is a diagram schematically showing configuration of a water discharge system 101' according to the fourth embodiment. As shown in the drawing, the water discharge system 101' includes a valve 72 provided on the downstream side of a sub water discharge line 36 for slurry, a collecting line 73 and a recycling line 74 connected to the valve 72, a valve 75 provided on the downstream side of a sub water discharge line 38 for pure water, and a collecting line 76 and a recycling line 77 connected to the valve 75.

In accordance with a result of the determination as to type of the used water based on the result of measurement carried out by a measurement device 37, a valve 31 switches among the sub water discharge lines 34, 36, and 38, to which the used water is to be introduced. More specifically, if the used water is slurry, the valve 31 introduces the used water to the sub water discharge line 36. If the used water is pure water, the valve 31 introduces the used water to the sub water discharge line 38. If the used water is some other liquid, the valve 31 introduces the used water to the sub water discharge line 34.

In accordance with a result of the determination as to whether the used water can be recycled based on the result of measurement carried out by the measurement device 37, the valve 72 switches between the collecting line 73 and the recycling line 74, to which the used water from the sub water discharge line 36 is to be introduced. Likewise, the valve 75 switches between the collecting line 76 and the recycling line 77, to which the used water from the sub water discharge line 38 is to be introduced.

FIG. 11 is a diagram schematically showing the configuration of a water discharge system 101" that is a modification of the system shown in FIG. 10. As shown in the drawing, the water discharge system 101" includes sub water discharge lines 34, 36, 38, 78, and 79 that are connected to a valve 31. The sub water discharge line 34 collects "some other liquid" not to be recycled. The sub water discharge line 36 is a collecting line for slurry, and the sub water discharge line 78 is a recycling line for slurry. The sub water discharge line 38 is a collecting line for pure water, and the sub water discharge line 79 is a recycling line for pure water.

As described above, the collecting lines 34, 36, and 38, and the recycling lines 78 and 79 may be arranged in parallel via the valve 31 on the downstream side of the main water discharge line 33, and the single valve 31 may switch among the lines, through which water is to be discharged.

Fifth Embodiment

The fifth embodiment described below concerns the cleaner 5 and the water discharger 9B of the cleaner 5 shown in FIG. 2.

FIG. 12 is a schematic perspective view of the cleaner 5. Although FIG. 12 is for explaining roll-sponge cleaning, pencil cleaning may be performed. The cleaner 5 is an example of a substrate processor. As shown in FIG. 12, the cleaner 5 includes: four rollers 301 through 304 that hold a substrate W in a substantially horizontal position and rotate the substrate W; roll sponges (cleaning tools) 307 and 308 that are brought into contact with the upper and lower surfaces of the substrate W; rotating mechanisms 310 and 311 that rotate the roll sponges 307 and 308; cleaning liquid supply nozzles 315 and 316 that supply a cleaning liquid (pure water, for example) to the upper and lower surfaces of the substrate W; and etching liquid supply nozzles 317 and 318 that supply an etching liquid (a chemical liquid) to the upper and lower surfaces of the substrate W.

The rollers 301 through 304 can be moved in such directions as to move close to one another and move away from one another, by drive mechanisms (air cylinders, for example) that are not shown in the drawing. The rotating mechanism 310 that rotates the upper roll sponge 307 is attached to a guide rail 320 that guides the rotating mechanism 310 in upward and downward directions. The rotating mechanism 310 is supported by a vertical drive mechanism 321, and the rotating mechanism 310 and the upper roll sponge 307 are moved up and down by the vertical drive mechanism 321. Although not shown in the drawing, the rotating mechanism 311 that rotates the lower roll sponge 308 is also supported by a guide rail, and the rotating mechanism 311 and the lower roll sponge 308 are moved up and down by a vertical drive mechanism. The vertical drive mechanisms may be motor drive mechanisms that use ball screws, or may be air cylinders, for example.

When the substrate W is taken in or out, the roll sponges 307 and 308 are located at a distance from each other. When the substrate W is cleaned, the roll sponges 307 and 308 move in such directions as to become closer to each other, and come into contact with the upper and lower surfaces of the substrate W. The force with which the roll sponges 307 and 308 push the upper and lower surfaces of the substrate W is adjusted by the vertical drive mechanism 321 and the unshown vertical drive mechanism, respectively. Since the upper roll sponge 307 and the rotating mechanism 310 are supported from below by the vertical drive mechanism 321, the pushing force to be applied to the upper surface of the substrate W by the upper roll sponge 307 can be adjusted from 0 N.

The roller 301 has a two-tier structure formed with a holding portion 301*a* and a shoulder portion (a supporting Portion) 301*b*. The diameter of the shoulder portion 301*b* is larger than the diameter of the holding portion 301*a*, and the holding portion 301*a* is formed on the shoulder portion 301*b*. The rollers 302 through 304 each have the same structure as the roller 301.

The substrate W conveyed by a conveying mechanism 9 is first placed on the shoulder portions 301*b* through 304*b*. After that, the rollers 301 through 304 move toward the substrate W, so that the substrate W is held by the holding portions 301*a* through 304*a*. At least one of the four rollers 301 through 304 is rotatively driven by a rotating mechanism (not shown), so that the substrate W rotates while the outer circumferential portion of the substrate W is held by the rollers 301 through 304. The shoulder portions 301*b* through 304*b* each have a downward tapered surface. While being held by the holding portions 301*a* through 304*a*, the substrate W is kept not in contact with the shoulder portions 301*b* through 304*b*.

In substrate cleaning, pure water cleaning is normally performed in the following manner: 1) a polished substrate is cleaned with a cleaning liquid, and 2) the cleaning liquid and the cleaning material used in the cleaning are washed off.

As described above, pure water and a chemical liquid are used in the cleaner 5. Therefore, used pure water and a used chemical liquid are discharged. In view of this, a water discharge system according to this embodiment is used in these processes and mechanisms.

FIG. 13 is a diagram schematically showing the configuration of a water discharge system 102 according to the fifth embodiment. The water discharge system 102 is formed with the water discharger 9B and a control mechanism 6. The difference from the system shown in FIG. 5 is that the water discharger 9B has only two water discharge lines: a water discharge line 41 for a used chemical liquid, and a water discharge line 43 for used pure water (the water discharger 9B may of course have a total of three water discharge lines, including a water discharge line for some other liquid). For pure water cleaning, the discharger 9B may have only two water discharge lines for used pure water and some other liquid. A "used chemical liquid" is a liquid that is used as a cleaning chemical liquid, and contains primarily cleaning chemical components after chemical cleaning.

A processing operation to be performed by the water discharge system 102 is substantially the same as that shown in FIG. 6. That is, in accordance with the pH of used water and the number of particles in used water, the control mechanism 6 determines to which water discharge line water should be discharged, and controls a switching device 17 as appropriate. In a case where the water discharge line for some other liquid is not prepared, or where the number of particles in used water is large, water may be discharged to the water discharge line 43 for a used chemical liquid.

Through this process, the used liquid is appropriately discharged as used pure water or a used chemical liquid through one of the two water discharge lines 41 and 43.

In the case of the cleaner 5, a water discharge method according to this embodiment is particularly effective not only for substrate cleaning but also for standing by for apparatus operation. In an apparatus operation standby state in which the apparatus is not operating, the cleaner 5 might use a large amount of pure water to clean components (the roll sponges 307 and 308, for example) of the cleaner 5 or moisturize the components so as to avoid drying. In such a case, the pure water can be discharged as used pure water, which is remarkably effective in recycling the pure water.

Also, a main water discharge line may be connected to the bottom portion of a used liquid container 12, and a water discharge line for a used chemical liquid and a water discharge line for used pure water may be connected to the main water discharge line via the switching device 17, as in the second embodiment.

In a case where a wafer is polished with two or more kinds of slurry, these two or more kinds of used slurry can be collected after separated from one another. Thus, separation and collection in a substrate processing apparatus can be realized, and expensive slurry can be reprocessed and reused.

Also, as shown in FIG. 14, a collecting line 41 and a recycling line 81 may be connected to a valve 21, and a collecting line 43 and a recycling line 82 may be connected to a valve 23, as in the third embodiment (FIG. 9). Further, collecting lines and recycling lines may be connected in parallel on the downstream side of a main water discharge line, as in the fourth embodiment (FIG. 10 or 11).

The above embodiments that can embody the present invention are disclosed for enabling those with ordinary knowledge in the technical field of the present invention to carry out the Present invention. Various modifications of the above embodiments should be obvious to those skilled in the art, and the technical ideas of the present invention can be applied to other embodiments.

Therefore, the present invention is not limited to embodiments disclosed herein, and should be construed in accordance with the technical ideas of the invention defined by the claims.

REFERENCE SIGNS LIST

1, 2 Substrate processing apparatus
3 Polisher
4 Housing
5 Cleaner
6 Control mechanism
6*a* Input module
6*b* Determiner
6*c* Output module
7 Water discharger
8 Housing
9A, 9B Water discharger
11 Used liquid
12 Used liquid container
13 Water discharge line
15 Measurement device
17 Switching device
19 Discharger
21, 23, 25, 72, 75 Valve
24, 26, 28 Water discharge line
27A, 27B, 27C Measurement device
31 Variable valve
33 Main water discharge line
34, 36, 38, 70, 71, 73, 74, 76 to 79, 81, 82 Water discharge line
37 Measurement device
100, 101, 101', 101", 102, 102' Water discharge system

What is claimed is:

1. A substrate processing apparatus comprising:

a substrate processor that processes a substrate using one or more liquids;

at least two discharge lines capable of discharging varying fluids produced by the substrate processor and including the one or more liquids having been used in a processing process of the substrate processor;

one or more valves configured to selectively switch among the at least two discharge lines in respect of which fluid produced by the substrate processor is to be selectively discharged;

a discharged fluid property measurement device configured to measure in at least one of the at least two discharge lines one or more properties of the discharged fluid having been used in the substrate processor and then discharged, and to generate information regarding the one or more properties of the discharged fluid;

a used liquid container configured to receive the discharged fluid having been used in the substrate processor, the used liquid container comprising a sloped bottom portion having a first portion at one side portion of the used liquid container and a second portion at another side portion of the used liquid container, wherein the another side portion of the used liquid container is disposed beneath a polishing table of the substrate processor, wherein the sloped bottom portion is sloped from the first portion to the second portion in a continuously declining manner, wherein the at least two discharge lines are separately coupled to the sloped bottom portion and are not coupled to edges of the sloped bottom portion, and wherein a first discharge line of the at least two discharge lines is coupled to the sloped bottom portion at a lower position than a second discharge line of the at least two discharge lines;

a housing that commonly houses the substrate processor, the at least two discharge lines, the one or more valves, and the measurement device; and a control mechanism communicatively coupled to the one or more valves and configured to control opening and closing of the one or more valves in response to the discharged fluid property information generated by and received from the measurement device.

2. The substrate processing apparatus according to claim 1, wherein the discharged fluid property information includes at least one of an amount of the fluid to be discharged, a fluid discharge time, pH of the fluid to be discharged, a number of particles in the fluid to be discharged, a degree of viscosity of the fluid to be discharged, and an electrical resistivity of the fluid to be discharged.

3. The substrate processing apparatus according to claim 1, wherein the measurement device is installed on at least one of the at least two discharge lines.

4. The substrate processing apparatus according to claim 1, wherein the measurement device is installed inside at least one of the at least two discharge lines.

5. The substrate processing apparatus according to claim 1, wherein the substrate processing apparatus is used in at least one of a substrate polishing process, a substrate cleaning process, an apparatus operation standby process, and a device cleaning process.

6. The substrate processing apparatus according to claim 1, wherein the control mechanism controls the one or more valves to selectively open or close, when the discharged fluid information indicates a preset amount of fluid to be discharged and a preset fluid discharge time, and that a pH value of the fluid to be discharged falls within a range of 6.0 to 8.0, a number of particles in the fluid to be discharged is outside a preset range, and a degree of viscosity of the fluid to be discharged is not lower than 0.88 mPa·s and not higher than 0.90 mPa·s (at 25° C.).

7. The substrate processing apparatus according to claim 1, wherein the substrate processor uses slurry and pure water, wherein the at least two discharge lines further include a third discharge line, and wherein the first discharge line is configured to discharge the slurry, the second discharge line is configured to discharge the pure water, and the third discharge line is configured to discharge another fluid.

8. The substrate processing apparatus according to claim 7, wherein the used liquid container is configured to receive the slurry and the pure water used in the substrate processor, and wherein the first discharge line is coupled to the sloped bottom portion at a lower position than the third discharge line.

9. The substrate processing apparatus according to claim 1, wherein the substrate processor is a cleaner configured to clean the substrate using pure water and a chemical liquid, and wherein the first discharge line is configured to discharge the pure water and the second discharge line is configured to discharge the chemical liquid.

10. The substrate processing apparatus according to claim 1, wherein the at least two discharge lines further comprise recycling line, and wherein the control mechanism selectively controls opening and closing of the one or more valves taking into account pre-defined recyclability and non-recyclability profiles as they apply to the discharged fluid based on the discharged fluid property information generated by and received from the measurement device.

11. The substrate processing apparatus according to claim 1, wherein the at least two discharge lines, the one or more valves, and the measurement device are installed inside the substrate processor.

12. The substrate processing apparatus according to claim 1, wherein the substrate processor is a polisher that polishes the substrate, and wherein the polisher comprises:

the polishing table on which a polishing pad is provided; and the used liquid container provided under the polishing table and covering a surrounding of the polishing table.

13. The substrate processing apparatus according to claim 12, wherein the polishing table and the used liquid container are provided in the housing.

14. The substrate processing apparatus according to claim 1, wherein the one or more valves are located directly under the used liquid container.

15. The substrate processing apparatus according to claim 1, wherein the one or more valves and the discharged fluid property measurement device are located directly under the used liquid container, and wherein the discharged fluid property measurement device is located above the one or more valves.

16. A substrate processing apparatus comprising:

a substrate processor that processes a substrate using one or more liquids;

at least two discharge lines capable of discharging varying fluids produced by the substrate processor and including the one or more liquids having been used in a processing process of the substrate processor;

a switching device configured to selectively switch among the at least two discharge lines in respect of which fluid produced by the substrate processor is to be selectively discharged;

a measurement device configured to measure in at least one of the at least two discharge lines one or more properties of the discharged fluid having been used in the substrate processor and then discharged, and to generate information regarding the one or more properties of the discharged fluid;

a housing that commonly houses the substrate processor, the discharge lines, the switching device, and the measurement device; and a control mechanism communicatively coupled to the switching device and configured to control opening and closing of the switching device in response to the discharged fluid property information generated by and received from the measurement device, wherein the substrate processor includes a used liquid container for catching the one or more liquids having been used in a processing process of the substrate processor, the used liquid container comprising a sloped bottom portion having a first portion at one side portion of the used liquid container and a second portion at another side portion of the used liquid container, wherein the another side portion of the used liquid container is disposed beneath a polishing table of the substrate processor, wherein the sloped bottom portion is sloped from the first portion to the second portion in a continuously declining manner, and wherein the at least two discharge lines are separately, fluidly coupled to the sloped bottom portion and are not coupled to edges of the sloped bottom portion of the used liquid container at respective openings that are radially spaced apart from one another along the sloped bottom portion of the used liquid container, and wherein a first discharge line of the at least two discharge lines is coupled to the sloped bottom portion at a lower position than a second discharge line of the at least two discharge lines.

17. The substrate processing apparatus according to claim 7, wherein the switching device includes one or more valves.

18. A substrate processing apparatus comprising:

a substrate processor which is a cleaner that cleans a substrate using one or more liquids;

at least two discharge lines capable of discharging varying fluids produced by the substrate processor and including the one or more liquids having been used in a processing process of the substrate processor;

one or more valves configured to selectively switch among the at least two discharge lines in respect of which fluid produced by the substrate processor is to be selectively discharged;

a discharged fluid property measurement device configured to measure in at least one of the at least two discharge lines one or more properties of the discharged fluid having been used in the substrate processor and then discharged, and to generate information regarding the one or more properties of the discharged fluid;

a housing that commonly houses the substrate processor, the discharge lines, the one or more valves, and the measurement device; and a control mechanism communicatively coupled to the one or more valves and configured to control opening and closing of the one or more valves in response to the discharged fluid property information generated by and received from the measurement device, wherein the cleaner comprises:

a substrate holder configured to hold the substrate; and a used liquid container provided under a face at which the substrate is held by the substrate holder, the used liquid container having a sloped bottom portion having a first portion at one side portion of the used liquid container and a second portion at another side portion of the used liquid container, wherein the another side portion of the used liquid container is disposed beneath a polishing table of the substrate processor, wherein the sloped bottom portion is sloped from the first portion to the second portion in a continuously declining manner, wherein the at least two discharge lines are separately coupled to the sloped bottom portion and are not coupled to edges of the sloped bottom portion, and wherein a first discharge line of the at least two discharge lines is coupled to the sloped bottom portion at a lower position than a second discharge line of the at least two discharge lines.

* * * * *